US006318026B1

(12) United States Patent
Ayres et al.

(10) Patent No.: US 6,318,026 B1
(45) Date of Patent: Nov. 20, 2001

(54) METAL DOOR INSERT

(76) Inventors: Terry Ayres; Troy D. Ayres, both of 3877 Cruzen Rd., Mikado, MI (US) 48745

( * ) Notice: Subject to any disclaimer, the term of this patent is extended or adjusted under 35 U.S.C. 154(b) by 0 days.

(21) Appl. No.: 09/388,252

(22) Filed: Sep. 1, 1999

Related U.S. Application Data

(60) Provisional application No. 60/098,833, filed on Sep. 2, 1998.

(51) Int. Cl.[7] ..... E06B 3/00

(52) U.S. Cl. ..... 49/503; 70/370; 70/417; 70/451; 70/466

(58) Field of Search ..... 49/503, 394; 70/417, 70/451, 370, 466

(56) References Cited

U.S. PATENT DOCUMENTS 4,218,848 * 8/1980 Nelson ..... 49/503
4,407,537 * 10/1983 Ames ..... 49/503 X
4,561,212 * 12/1985 Ullman ..... 49/503
4,887,856 * 12/1989 Percoco et al. ..... 292/3 X
5,406,814 * 4/1995 Zeager et al. ..... 70/102
5,906,493 * 5/1999 Bishop ..... 49/503 X

* cited by examiner

*Primary Examiner*—Jerry Redman
(74) *Attorney, Agent, or Firm*—Reising, Ethington, Barnes, Kisselle, Learman & McCulloch, P.C.

(57) ABSTRACT

The door insert has a vertical rib that contacts an inside surface of a door edge. A continuous wall forming a latch control chamber is connected to the vertical rib by a bridge. A latch passage passes through the vertical rib, the bridge, the continuous wall and opens into the latch control chamber. Ribs on the outside surface of the continuous wall anchor the insert inside a steel door when the door is filled with foam. A deadbolt control chamber can be added if desired.

23 Claims, 4 Drawing Sheets

METAL DOOR INSERT

This application claims the benefit of U.S. Provisional Application No. 60/098,833 filed Sep. 2, 1998.

TECHNICAL FIELD

This invention is in a door construction and more particularly in a metal door with inserts for holding latches and locks. The disclosure incorporates the metal door insert disclosed in provisional patent application 60/098,833, filed Sep. 2, 1998, whose priority is claimed for this application.

BACKGROUND OF THE INVENTION

Doors for homes and offices are often metal. Metal doors are fire resistant. Due to their fire resistance, insurance companies encourage their use. Manufacturers of metal doors are now able to provide insulation that reduces moisture condensation problems encountered in the past. Manufacturers have also learned how to form outer surfaces that are attractive and durable.

Wood inserts are placed inside the doors for mounting latches and locksets and also for mounting dead bolts. The wood blocks must be free of knots and blemishes. In addition, the wood must hold screws that secure face plates for latches and dead bolts. If a wood block splits when a screw is screwed into it, the doors is essentially destroyed. Once insulation is injected into the hollow interior of the door, the wood blocks cannot be replaced.

Wood suitable for making metal door insert blocks is scarce. Much of the available wood has knots that preclude its use for making door inserts. Some wood is too soft to hold the required screws for attaching face plates. Other available woods are brittle and tend to split when screws are inserted into them. As a result of the scarcity of suitable wood for door inserts and increased demand for metal doors, the wood that is available has become expensive.

Manufacturers of metal doors have taken steps to conserve wood. Wood can be conserved by reducing the size of the blocks that are inserted. When the size of the wood block inserts is reduced, an individual block can only accommodate a latch and lockset with one predetermined set back distance. The set back distance is the distance from the edge of the door to the center of the latch or dead bolt control members. The wood block insert for the dead bolt also accommodates dead bolts with one specific size. As a result, metal door manufacturers have to maintain a supply of several wood block inserts and metal door retailers must maintain an inventory of doors that will accommodate various latch and lock assemblies as well as a variety of dead bolts.

SUMMARY OF THE INVENTION

An object of the invention is to provide a composite material door insert block for a metal door.

Another object of the invention is to provide a door insert block, for a metal door, that has superior screw retention.

A further object of the invention is to provide a door insert block for a metal door that can accommodate door hardware with more than one nominal size.

A still further object of the invention is to provide a door insert block, for a metal door, with recesses that receive foam insulation and that is anchored in place by the insulation.

A yet still further object of the invention is to provide a door insert block, for a metal door, that has integral alignment projections that align the insert block in the door.

The door insert block is formed from a composite material. The material has fibers in a plastic matrix that are selected from a variety of materials that provide the desired properties. The plastic matrix can be a thermoplastic or a thermoset material. Polypropylene has been found to work well. The fibers can be natural fibers such as wood or man made fibers. This composite can be drilled, cut and worked with tools normally used when working with hard woods. The material holds its shape, is non-compressible and holds wood screws well.

The door insert block is formed by molding or by extrusion. If it is formed by molding all of the cavities and passages can be formed in one operation. If the door insert block is formed by extruding, some passages will have to be formed after the block passes through the extrusion dye. A modified extrusion process referred to as pull trusion may be required if fibers are employed that cannot be forced through a dye using conventional extrusion equipment and processes.

The door insert block has a plurality of ribs that extend from the inside surface of one of the doors large panels to the inside surface of the opposite large panel. These ribs form a plurality of chambers. One or more of the chambers may be used to house control members for operating a door latch. A door lock can be provided to prevent the latch from being released. Another chamber may be used to house the control members for moving a dead bolt into and out of locking position. The dead bolt will generally also include a lock. If a lock is included, the dead bolt can be operated and closed with a manual controller on one side of the door and with a key on the other side of the door.

One of the ribs has an outer surface that is positioned adjacent to an inside surface of the door edge opposite the door edge with door hinges. The rib that is adjacent to a door edge may have alignment surfaces for aligning the insert block relative to the door. The rib adjacent to the door edge with alignment surfaces may also have retainers for holding the insert block in a fixed position relative to the door.

Latch and dead bolt passages pass from an outer surface of the rib adjacent to a door edge to the chambers for door latch and dead bolt control members. The rib adjacent to the door edge also receives screws that secure the face plates for door latches and dead bolts in place.

Passages are provided in some of the ribs for the entry of foam insulation material into chambers formed by the ribs. It is preferable to fill all the chambers formed by the ribs with foam except the chambers that house control members for operating door latches and dead bolts. The foam strengthens the insert block and anchors the insert block in place within a door as well as reducing the rate of heat transfer. Foam is injected into the chambers within the insert block at the same time it is injected into the entire door cavity.

The chambers in the insert block for housing the control members for operating a door latch and for operating a dead bolt, if a dead bolt is used, are preferably elongated. By providing elongated chambers, they can accommodate door hardware with a range of door latch lengths and a range of dead bolt lengths.

Dead bolts are not used on most doors. If desired, the chamber for housing a dead bolt control member can be eliminated from the insert block. The ribs that form the insert block provide sufficient strength to support a dead bolt if it is desired to add a dead bolt at a future date. The required passages can be drilled into the insert block and foam filled chambers in the same way they are currently drilled into wood insert blocks.

BRIEF DESCRIPTION OF THE DRAWINGS

The presently preferred embodiments of the invention are disclosed in the following description and in the accompanying drawings, wherein.

DESCRIPTION OF THE PREFERRED EMBODIMENTS

Figure 1:
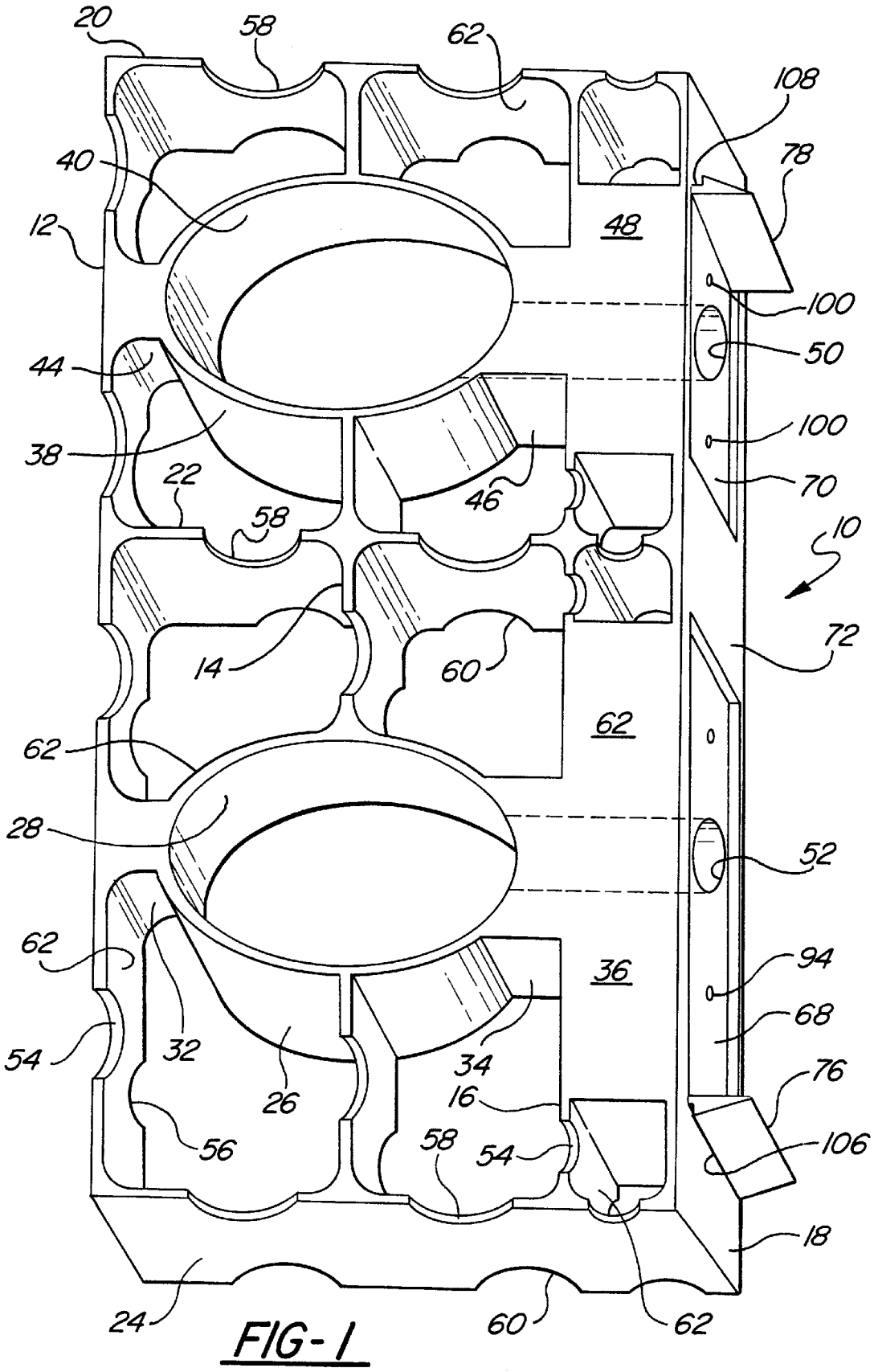
FIG. 1 is a perspective view of the metal door insert with chambers and passages that accommodate a door latch as well as a dead bolt.

The metal door insert 10, as shown in FIG. 1, has vertical ribs 12, 14, 16, and 18. Horizontal ribs 20, 22, and 24 are integral with the vertical ribs 12, 14, 16, and 18. An oval shaped wall 26 forms a chamber 28 for housing control members that operate a door latch 30. The chamber 28 is between the horizontal ribs 22 and 24. The wall 26 that forms the chamber 28 is connected to the vertical rib 12 by a bridge 32. A bridge 34 connects the wall 26 to the vertical rib 16. A solid block member 36 is integral with the vertical ribs 16 and 18 and extends from the bridge 34 to the vertical rib 18. The size of the chamber 28 is An oval shaped wall 38 forms a chamber 40 for housing control members that operate a dead bolt 42. The wall 38 that forms the chamber 40 is connected to the vertical rib 12 by a bridge 44. A bridge 46 connects the wall 38 to the vertical rib 16. A solid block member 48 is integral with the vertical ribs 16 and 18 and extends from the bridge 46 to the vertical rib 18. The size of the chamber 40 is larger along a horizontal axis than along a vertical axis. This extra length of the chamber 40 permits the door insert 10 to accommodate dead bolts 42 with a range of lengths.

The chambers 28 and 40 form breaks in the vertical rib 14 as shown in FIG. 1. As described chamber 28 houses control members that operate the door latch 30 and the chamber 40 houses control members that operate the dead bolt 42. If desired, the dead bolt 42 could be mounted in the lower chamber 28 and the door latch 30 could be mounted in the upper chamber 40.

A horizontal passage 50 is formed through the solid block member 48 and the bridge 46 and passes from the surface of the vertical rib 18 opposite the upper chamber 40 to the vertical center of the upper chamber. A horizontal passage 52 is formed through the solid block 36 and the bridge 34 and passes from the surface of the vertical rib 18 opposite the lower chamber 28 to the vertical center of the lower chamber. Both horizontal passages 50 and 52 can be molded into the insert block 10 or they can be formed by drilling after the insert block is cured.

Recesses 54 and 56 in the vertical ribs 12, 14, and 16 and recesses 58 and 60 in the horizontal ribs 20, 22, and 24 permit the entry of a foam producing agent into the chambers 62. This agent is inserted into the inside of a metal door to form foam insulation 64 after the door 66 is assembled. The foam producing agent enters all of the chamber 62 in the insert block 10, except the chambers 28 and 40, through the recesses 54, 56, 58, and 60. Because the chambers 62 have limited openings formed by the recesses 54, 56, 58, and 60, the foam insulation 64 in the chambers 62 tends to be relative dense. The density of the foam is increased because it is confined to the small chambers 62 during expansion of the foaming agent. In addition to insulating a door 66, the foam 64 strengthens the door insert block 10 and anchors the insert block within the door.

Face plate support surfaces 68 and 70 are recessed slightly from the surface 72 of the rib 18 as shown in FIG. 1. By recessing the surfaces 68 and 70, the outer surface of plates 90 and 96 are in the same plane as the surface 72. However, the position of the surfaces 68 and 70 can be changed as required to accommodate a specific metal door construction.

Spring retainers 76 and 78 may be provided on the door insert 10 if desired. These retainers 76 and 78 pass through face plate apertures 77 and 79 in a door edge 74 and snap in place to hold a door insert 10 in place adjacent to the door edge. After the foam insulation 64 cures and firmly anchors the door insert 10, the retainers 76 and 78 are removed. The spring retainers 76 and 78 are preferably made at the same time the remainder of the door insert is formed. The spring retainers 76 and 78 are made from the same material that the door insert 10 is made from. However, the spring retainers 76 and 78 could be separate members attached to the door insert 10 after the door insert is formed.

Figure 2:
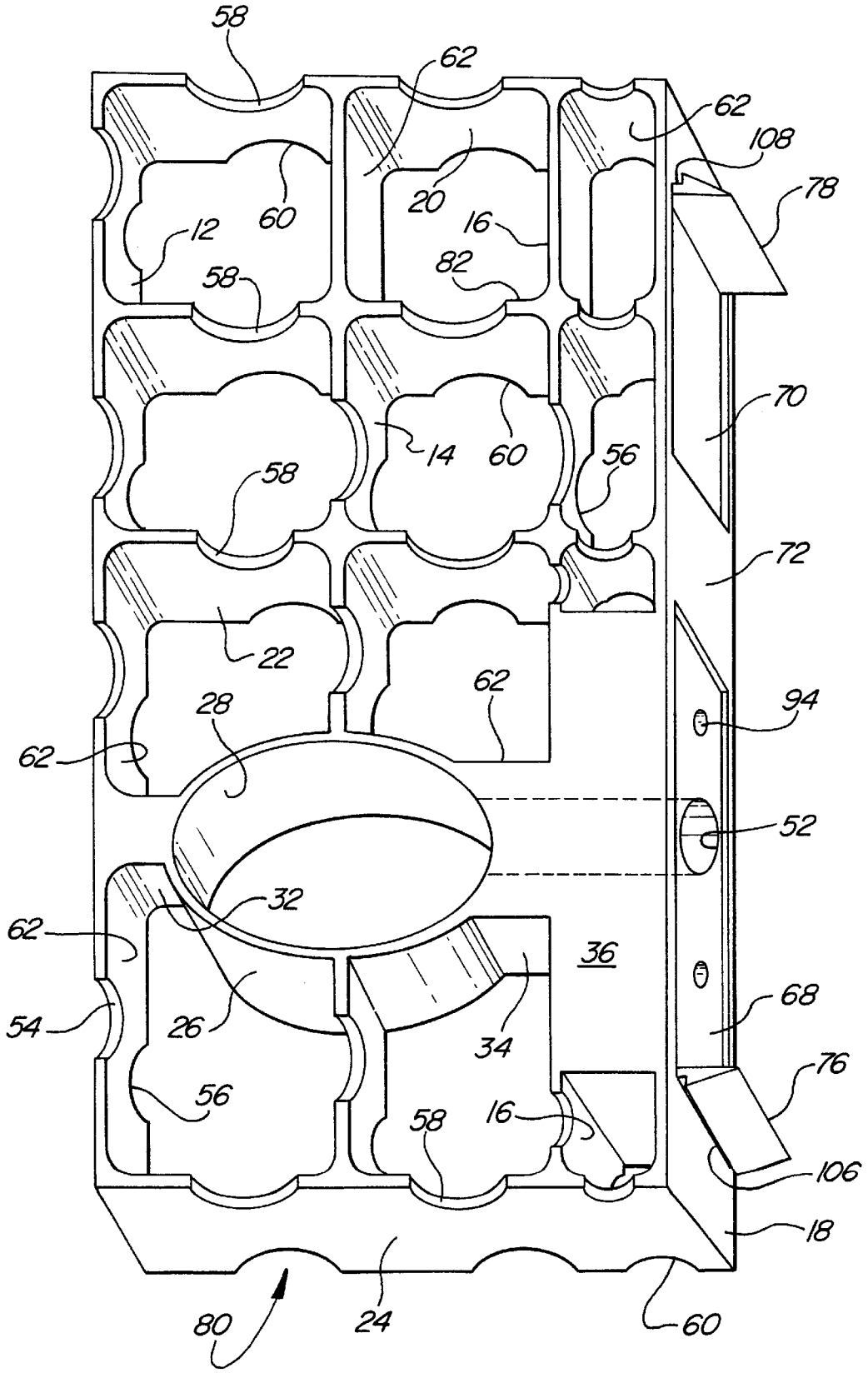
FIG. 2 is a perspective view of the metal door insert with a chamber that accommodates a door latch but not a dead bolt.
Figure 4:
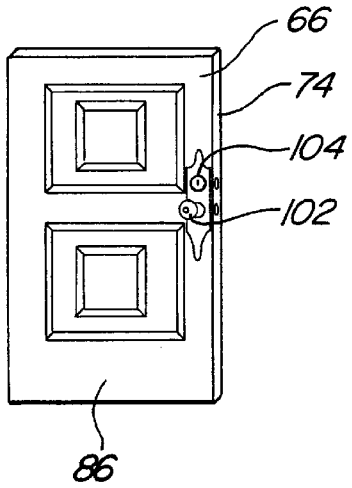
FIG. 4 is a perspective view of a metal door with a door latch and a dead bolt installed.

The metal door insert 80 shown in FIG. 2 is identical to the door insert 10 described above with the exception of eliminating the chamber 40 for a dead bolt 42 and a dead bolt control member. Elimination of the chamber 40 eliminates the bridge 44, the bridge 46 and the solid block member 48. The vertical rib 14 extends across the space for the chamber 40 and ribs 16 and 18 remain without a horizontal passage 50. A horizontal rib 82 passes through the area that was taken up by the chamber 40. Since the remainder of the door insert 80 is identical to the door insert 10, the same reference numbers are used to describe these common parts. Descriptions of the common parts with the same reference numbers are found above.

A dead bolt 42 can be added to a door 66 with the door insert 80 shown in FIG. 2 after the door insert is anchored in place by the cured foam by drilling the required passages following the same procedures used with doors that have wood block inserts. One of the passages is drilled through the vertical ribs 16 and 18 and is parallel to the horizontal rib 82. This passage corresponds to the passage 50 and may pass through a portion of the horizontal rib 82. The larger diameter passage forms a chamber for the dead bolt operating mechanism. This larger diameter passage performs the same function as the chamber 40 but is somewhat smaller because it is drilled to accommodate a dead bolt 42 with a specific length. The portions of the vertical ribs 12, 14, 16, and 18 and the horizontal ribs 20, 22, and 82 that remain in combination with the foam insulation provide sufficient strength to support a dead bolt 42.

Figure 3:
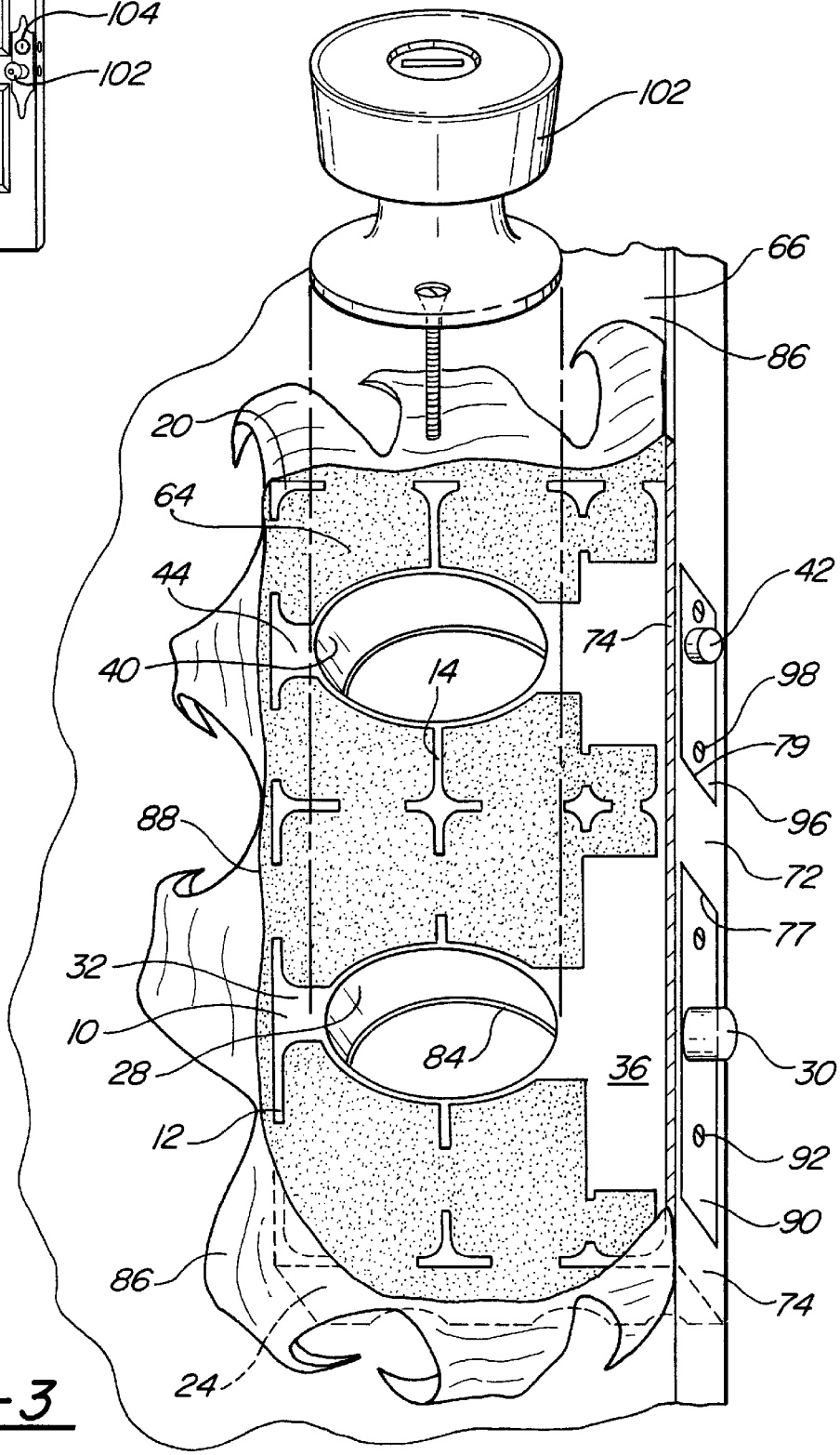
FIG. 3 is an enlarged perspective view of a portion of a metal door taken at area 3 in FIG. 4 with a door insert of FIG. 1 and with parts broken away.

The metal door insert 10 of FIG. 1 is shown installed in a door 66 in FIG. 3. The door 66 has an edge 74, a metal outside wall 84, and a metal inside wall 86. The cavities 62 within the door insert 10 are filled with a foam 64 or 88. The foam 64 and 88 fills all of the voids within the door 66 between the inner surfaces of the outside wall 84 and the inside wall 86 except the chambers 28 and 40. The foam 64 in the door inserts 10 and 80 and the foam 88 in the remainder of the door 86 is the same foam and is formed simultaneously. However the foam 64 in the door inserts 10 and 80 is denser following curing as explained above. In addition to retarding heat transfer through the door 66, the foam 88 anchors the door insert 80 in place and strengthens the door insert.

The door latch 30 includes a latch faceplate 90. Screws 92 screw into the solid block member 36 and clamp the latch face plate 90 in place. Guide holes 94 for the screws 92 are preferably drilled into the solid block 36 at the time the faceplate 90 is installed to ensure a proper fit.

The dead bolt 42 includes a dead bolt faceplate 96. Screws 98 screw into the solid block 48 and clamp the dead bolt face plate 96 in place. These screws 98 are screwed into guide holes 100 that are preferably drilled into the solid block 48 at the time the dead bolt 42 is installed to ensure a proper fit.

A door latch control member 102 is mounted in the chamber 28 after the door latch 30 is installed. A dead bolt control member 104 is mounted in the chamber 40 after the dead bolt 42 is installed. The door control member 102 can be operated from either side of the door 66 and may include a latch lock assembly if desired. The dead bolt control member is operated by a lever or knob on the inside side of the door and by a key on the outside side of the door.

The door insert blocks 10, 80 or 110 are inserted into the inside cavity of a door 66 during manufacture of the door. Spring retainers 76 and 78 pass through the face plate apertures 77 and 79 in the edge 74 of the door 10. Portions of the edge 74 enter the recesses 106 and 108 at the base of the spring retainers 76 and 78 and hold the door insert 10 in place. After construction of the door 66 is substantially complete, a foam producing agent is inserted into the inside of the door and into the chambers 62 in the door insert 10 or 80. After the foam producing agent has cured, the spring retainers 76 and 78 are removed. The door is then ready for installation.

The door inserts 10 and 80 are described above as having horizontal ribs 20, 22, and 24 and vertical ribs 12, 14, 16, and 18. These ribs may have other shapes and orientation if desired. For example ribs could extend radially from the walls 26 and 38 that form the chambers 28 and 40. Rib segments could extend between adjacent radial ribs to form chambers. Passages through these ribs permit a foaming agent to enter the chambers and form a foam that anchors the door inserts in place and strengthens the door insert.

Figure 5:
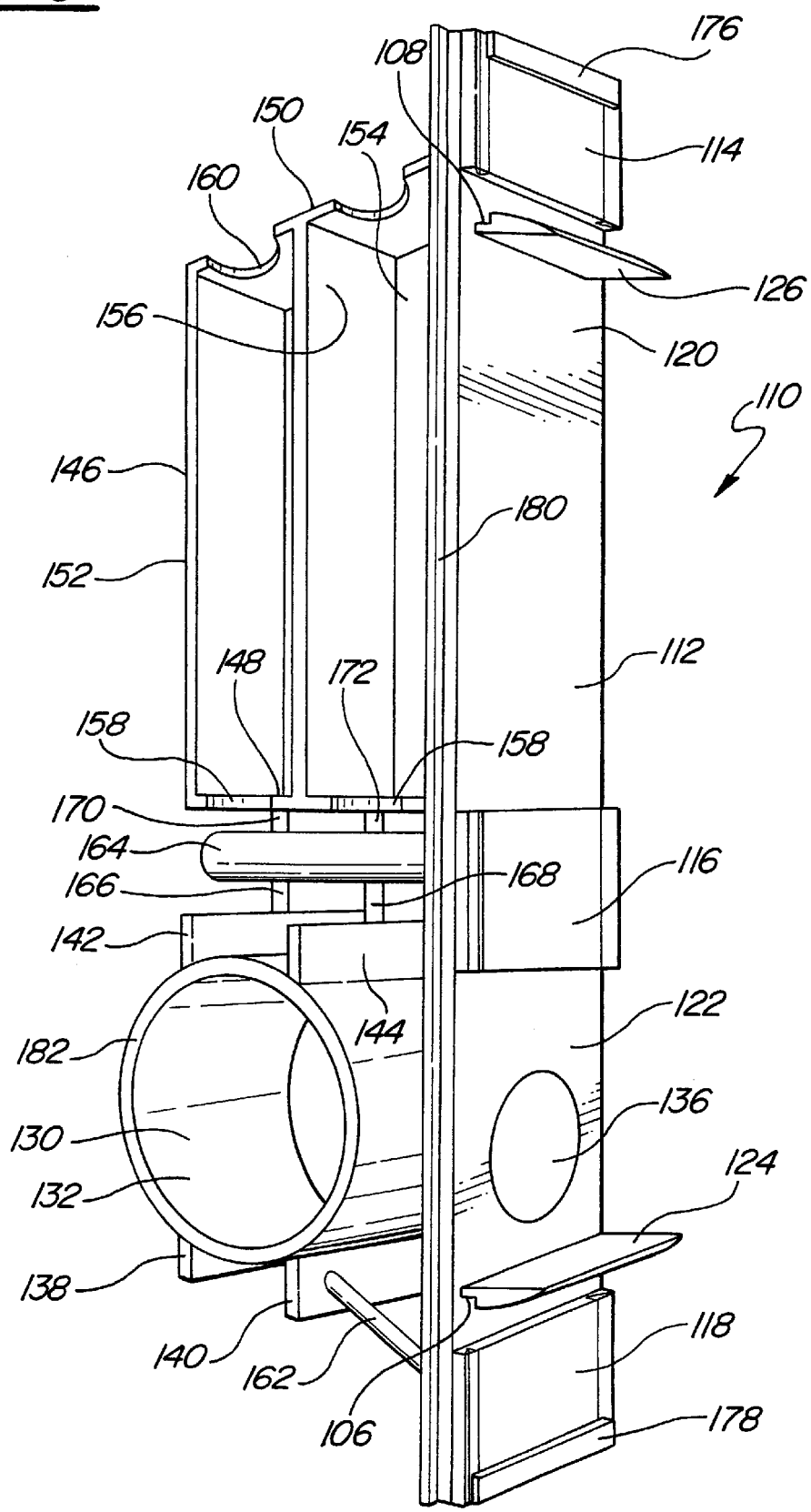
FIG. 5 is a perspective view of an alternate metal door insert having a modified construction.

A door insert 110, shown in FIG. 5, has a modified construction that differs somewhat from the construction of the door inserts 10 and 80 and inserts with radial ribs as described above. However all of these door inserts fit in the same metal doors and perform the same functions. The door insert 110 is a composite molded member. It can be molded employing polypropylene and wood fibers for example. A door insert 110 made from these components can be drilled, sawed and shaped using the same tools that are used when employing wood door inserts. Wood fibers and polypropylene composites have been found to have superior screw holding characteristics and strength when compared to high quality door inserts made from wood.

The door insert 110 has a rectangular vertical rib 112 with vertical surfaces 114, 116 and 118 that contact an inside surface of the metal door edge 74. Horizontally recessed surfaces 120 and 122 are the surfaces upon which the latch faceplate 90 and the dead bolt face plate 96 are seated. These vertical surfaces 120 and 122 are recessed because the faceplates 90 and 96 are generally thicker than the metal door edge 74.

Spring retainers 124 and 126 are integral with the vertical rib 112 and perform the same function as the spring retainers 76 and 78 described above. After the door insert 110 is mounted in a door cavity, the door is filled with foam and the foam has cured, the spring retainers 124 and 126 can be bent over and broken off or cut off with an appropriate woodworking tool.

A wall 130 that forms a chamber 132 is connected to the vertical rib 112 by a bridge 134. The bridge 134 is a tube with an internal bore 136 that passes through the vertical rib 112 as well as through the wall 130. A first pair of spaced apart short vertical ribs 138 and 140 extend vertically downward from the wall 130 and generally parallel to the vertical rib 112. A second pair of short spaced apart vertical ribs 142 and 144 extend vertically upward from the wall 130 and generally parallel to the first pair of spaced apart short vertical ribs 138 and 140.

A door latch 30 passes through the bore 136 and into the chamber 132. The chamber 132 can be cylindrical or oval. An oval chamber 132 will accommodate a larger range of door latch lengths. A door latch control 102 passes through the chamber 132 and engages the door latch 30.

A vertically elongated box 146 is formed above the chamber 132 by horizontal walls 148 and 150, vertical wall 152 and the vertical rib 112. The horizontal walls 148 and 150 are integral with the vertical rib 112 and have a width equal to the inside distance from an outside wall 84 to an inside wall 86 of a door 66. The vertical wall 152 is integral with the horizontal walls 148 and 150 and parallel to the rib 112.

The box 146 is divided into four chambers of substantially equal size by two flat walls 154 and 156. The first dividing flat wall 154 is in a vertical plane that is perpendicular to the vertical surfaces 120 and 122 of the vertical rib 112 and that is parallel to and half-way between the outside wall 84 and the inside wall 86 when the door insert 110 is mounted in a door 66. The second dividing flat wall 156 intersects the first dividing wall 154 and is parallel to the rib 112 and the vertical wall 152. The second dividing flat wall 156 also extends from the horizontal wall 148 to the horizontal wall 150. When the door insert 110 is mounted in a door 66, the second flat wall 156 also extends from the outside wall 84 to the inside wall 86. Four cutouts 158 are provided in the horizontal wall 148 and four cutouts 160 are provided in the horizontal wall 150 so that foam will fill the entire box 146.

After foam 64 cures inside a door 66, a deadbolt bore can be drilled through the vertical surface 120 and into the box 146 in various locations for receiving a deadbolt. Another bore for a deadbolt control member 104 can be drilled through the box 146 as well as through the outside wall 84 and the inside wall 86 of a door 66. This bore for the deadbolt control member can divide the second flat wall 156 and the door insert 110 will still provide adequate strength. The elongated box 146 provides substantial flexibility for determining the location of a deadbolt 42.

An angle brace 162 extends from the wall 130 and the short vertical rib 140 to the lower end of the vertical rib 112. A post 164 extends horizontally from the vertical rib 112 between the box 146 and the vertical ribs 142 and 144. Tire rods 166 and 168 connect the post 164 to the vertical ribs 142 and 144. Tie rods 170 and 172 connect the post 164 to the box 146. The brace 162, post 164 and tie rods 166, 168, 170 and 172 are all formed when the door insert is formed. Strength and rigidity is added, without impeding the flow of foam insulation material or adding significant weight, by the angle brace 162, the post 164 and the tie rods 166, 168, 170 and 172.

A bottom end seal 178 and a top end seal 176 are attached to the surfaces 114 and 118 on the vertical rib 112 of the door insert 110 if required. The inside surface of the door edge 74 of some steel doors 66 is not flat. The seals 176 and 178 prevent liquid foam from leaking from the inside of the door before the foam is cured. A lip 180 on each side of the rib 112 contacts an inside surface of the door 66 and forms a seal that retains uncured foam during construction of the door. Edge surfaces 182 on each edge of the continuous wall 130 are in sealing contact with inside surfaces of the outside wall 84 and the inside wall 86 to keep foam out of the chamber 132 and the bore 136.

The spring retainers 124 and 126 position and retain the door insert 110 in a door 66 during the foaming process. After the foam cures, the spring retainers 124 and 126 are broken from or cut from the door insert.

The disclosed embodiments are representative of a presently preferred forms of the invention, but are intended to be illustrative rather than definitive thereof. The invention is defined in the claims.

What is claimed is:

1. A hollow door insert for holding door latches comprising: a vertical rib with a front side having inside door contact surfaces and at least one face plate seating surface, and a back side; a bridge integral with the backside of said vertical rib; a continuous wall forming a latch control chamber that is integral with the bridge; a latch passage through said vertical rib, the bridge, and the wall forming the latch control chamber; and at least one rib integral with the continuous wall that extends outward from the latch control chamber and is spaced from said vertical rib.

2. A hollow door insert as set forth in claim 1 wherein said hollow door insert is a composite material.

3. A hollow door insert as set forth in claim 2 wherein the composite material is wood fibers and polypropylene.

4. A hollow door insert as set forth in claim 1 including one or more anchor ribs that are integral with the continuous wall and extend outwardly from the latch control chamber.

5. A hollow door insert as set forth in claim 1 wherein said hollow door insert includes a second continuous wall forming a deadbolt control chamber connected to said vertical rib by a deadbolt bridge and a deadbolt passage through said vertical rib, the deadbolt bridge and the second continuous wall.

6. A hollow door insert as set forth in claim 1 including a box member integral with the vertical rib and spaced from the latch control chamber, at least one box dividing wall dividing the box into multiple chambers and a plurality of foam producing agent entry apertures in the box.

7. A hollow door insert as set forth in claim 6 including a deadbolt passage through said vertical rib and into the box member and a deadbolt control chamber inside the box member.

8. A hollow door insert as set forth in claim 7 wherein the deadbolt control chamber passes through the at least one box dividing wall.

9. A hollow door insert as set forth in claim 6 including at least one rod member connecting the box member to the continuous wall forming the latch control chamber.

10. A hollow door insert as set forth in claim 1 including a pair of resilient retainers integral with the front side of the vertical rib.

11. A hollow door insert as set forth in claim 1 wherein the continuous wall forms an oval shaped latch control chamber having a long axis that is perpendicular to the vertical rib.

12. A hollow door insert for holding door latches comprising: a door latch control chamber wall; a face plate support rib; a plurality of ribs integral with the door latch control chamber wall; a door latch bridge extending from the face plate support rib to the door latch control chamber wall; and a door latch bore passing through the face plate support rib, the door latch bridge and the door latch control chamber wall.

13. A hollow door insert as set forth in claim 12 wherein the plurality of ribs form a plurality of chambers; and a plurality of foaming agent passages through the plurality of ribs provide access to the plurality of chambers.

14. A hollow door insert as set forth in claim 12 wherein the plurality of ribs include at least one rib connected directly to the face plate support rib.

15. A hollow door insert as set forth in claim 12 including: a deadbolt control chamber wall connected to at least one of the plurality of ribs; a deadbolt bridge extending from the face plate support rib to the deadbolt control chamber wall; and a deadbolt latch bore passing through the face plate support rib, the deadbolt bridge and the deadbolt control chamber wall.

16. A hollow door insert as set forth in claim 12 wherein said door insert is a composite material.

17. A hollow door insert as set forth in claim 12 including a pair of resilient retainers integral with the face plate support rib for positioning and holding said hollow door insert in a fixed position in a hollow door.

18. A hollow door insert for holding door latches as set forth in claim 12 wherein the hollow door insert is a one piece plastic material.

19. A hollow door insert for holding the door latches as set forth in claim 18 wherein the one piece plastic material is a composite material including wood fibers.

20. A hollow door insert for holding door latches comprising: a door latch control chamber wall; a face plate support rib; a door latch bridge extending from the face plate support rib to the door latch control chamber wall; a door latch bore passing through the face plate support rib, the door latch bridge and the door latch control chamber wall; and wherein the door latch control chamber wall, the face plate support rib and the door latch bridge are a one piece plastic material.

21. A hollow door insert for holding door latches as set forth in claim 20 wherein the one piece plastic material is a wood fiber composite.

22. A hollow door insert for holding door latches comprising:

a door latch control chamber wall; a face plate support rib; a continuous rib encircling the door latch control chamber wall and forming at least one chamber between the continuous rib and the door latch control chamber wall; a door latch bridge extending from the face plate support rib, through the continuous rib and to the door latch control chamber wall; and a door latch bore passing through the face plate support rib, through the continuous rib and the door latch control chamber wall.

23. A hollow door insert for holding door latches as set forth in claim 22 wherein the door latch control chamber wall, the face plate support rib, the continuous rib and the door latch bridge are a one piece composite material including wood fibers.

* * * * *

UNITED STATES PATENT AND TRADEMARK OFFICE

CERTIFICATE OF CORRECTION

PATENT NO. : 6,318,026 B1
DATED : November 20, 2001
INVENTOR(S) : Terry Ayres and Troy D. Ayres It is certified that error appears in the above-identified patent and that said Letters Patent is hereby corrected as shown below:

Column 3,
Line 32, after "is" insert -- larger along a horizontal axis than along a vertical axis. This extra length of the chamber 28 permits the door insert 10 to accommodate door latches 30 with a range of lengths. --

Signed and Sealed this

Twenty-third Day of April, 2002

*Attest:*

*Attesting Officer*

JAMES E. ROGAN
*Director of the United States Patent and Trademark Office*